US009561424B1

(12) United States Patent
Abel

(10) Patent No.: US 9,561,424 B1
(45) Date of Patent: Feb. 7, 2017

(54) LOW-RIDER PROFILE ROLLER SKATES

(71) Applicant: Don E. Abel, Olney, IL (US)

(72) Inventor: Don E. Abel, Olney, IL (US)

( * ) Notice: Subject to any disclaimer, the term of this patent is extended or adjusted under 35 U.S.C. 154(b) by 0 days.

(21) Appl. No.: 15/065,982

(22) Filed: Mar. 10, 2016

(51) Int. Cl.
*A63C 17/02* (2006.01)
*A63C 17/22* (2006.01)
*A63C 17/00* (2006.01)

(52) U.S. Cl.
CPC ..... *A63C 17/02* (2013.01); *A63C 17/002* (2013.01); *A63C 17/226* (2013.01)

(58) Field of Classification Search
CPC ..... A63C 17/02; A63C 17/002; A63C 17/226
USPC ..... 280/11.19, 11.27, 825
See application file for complete search history.

(56) References Cited

U.S. PATENT DOCUMENTS 4,355,474 A * 10/1982 Grim ..... A43B 5/1633 280/825
6,488,289 B2 * 12/2002 Hsiao ..... A43B 5/06 280/11.208

* cited by examiner

*Primary Examiner* — John Walters
(74) *Attorney, Agent, or Firm* — Gary K. Price

(57) ABSTRACT

A low-rider roller skate having a first sole, a pair of front wheels attached to a front axle that is mounted to a front portion of the first sole, and a pair of wheels attached to a rear axle that is mounted to a rear portion of the first sole. The skate defines a longitudinal length, where the rear axle is perpendicular to the length, and the front axle is disposed at an angle to the length, such that the front axle is not parallel with the rear axle. The roller skate including a second sole member including a cap toe sized for receiving a toe-portion of the roller skate, and second heel that rests over a heel-portion of the roller skate, and an integral waist therebetween, the waist includes a front indent for receiving the front axle, and a rear indent for receiving the rear axle. With the second sole member attached, the skates no longer act as roller skates but are walking shoes. With the second sole member removed, the skates are low-rider skates.

20 Claims, 14 Drawing Sheets

LOW-RIDER PROFILE ROLLER SKATES

CROSS REFERENCES TO RELATED APPLICATIONS

U.S. Provisional Application for Patent No. 62/130,983, filed Mar. 10, 2015, with title "Low-Rider Profile Roller Skates" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

This invention relates generally to roller skates and more particularly to low-rider profile roller skates.

2. Brief Description of Prior Art

Roller skates are often used both as a source of recreation as well as a means for personal transportation. Traditional roller skates comprise of four wheels, with two wheels parallel to each other on either side of the toe end of a platform, and two wheels parallel to each other on either side of the heel end of the platform. An effort is typically made to keep all four rollers of both skates on the floor or pavement at all times, thereby maximizing control and balance.

However, the skate and roller configuration is such that the feet and legs must be contorted into uncomfortable positions when moving, especially over uneven terrain.

As will be seen from the subsequent description, the preferred embodiments of the present invention overcome disadvantages of the prior art roller skate. In this regard, the present invention discloses a roller skate that will provide increased speed through an overall decrease in the amount of friction between the wheels and the ground, as well as increased maneuverability by incorporating a low-rider profile design and by decreasing the overall weight of the roller skate thereby increasing the turning ability by giving the wearer an increased control over his or her center of gravity.

SUMMARY OF THE INVENTION

A stable roller skate design that includes a front axle situated approximately below the ball of the skater's foot, and a rear axle approximately positioned below the heel of the skater's foot. Further, while the rear axle is approximately perpendicular to a length of the roller skate, the front axle is disposed at an angle to the length. Unlike traditional roller skates, the front axle is therefore not parallel with the rear axle.

The roller skate further includes a first sole that preferably includes a magnet positioned approximately adjacent the rear axle. The magnet to releasably secure a second sole member by magnetic attraction. The second sole member is sized to slip over the first sole and configured to impede the wheels from rotating. With the second sole member attached, the pair of skates no longer act as roller skates but are walking shoes. With the second sole member removed, the skates are low-rider skates.

The second sole member generally includes a cap toe sized for receiving the toe-portion of the skate, and a second heel that rests over the heel-portion of the skate, and an integral waist therebetween. The waist includes a front indent for receiving the front axle, and a rear indent for receiving the rear axle. The waist further defines a first thickness adjacent the front indent such that when the front axle is received in the front indent, the first thickness prevents the front wheels from contacting the ground surface and therefore impedes the front wheels from rotating. Similarly, the waist defines a second thickness adjacent the rear indent such that when the rear axle is received in the rear indent, the second thickness prevents the rear wheels from contacting the ground surface and therefore impedes the rear wheels from rotating.

DESCRIPTION OF THE PREFERRED EMBODIMENT

The present invention is directed to a roller skate that will provide increased speed through an overall decrease in the amount of friction between the wheels and the ground as well as increased maneuverability. More particularly, the present invention incorporates a low-rider profile design that decreases the overall weight of the roller skate thereby increasing the turning ability by giving the wearer an increased control over his or her center of gravity. In the broadest context, the roller skate of the present invention consists of components configured and correlated with respect to each other so as to attain the desired objective.

Figure 1:
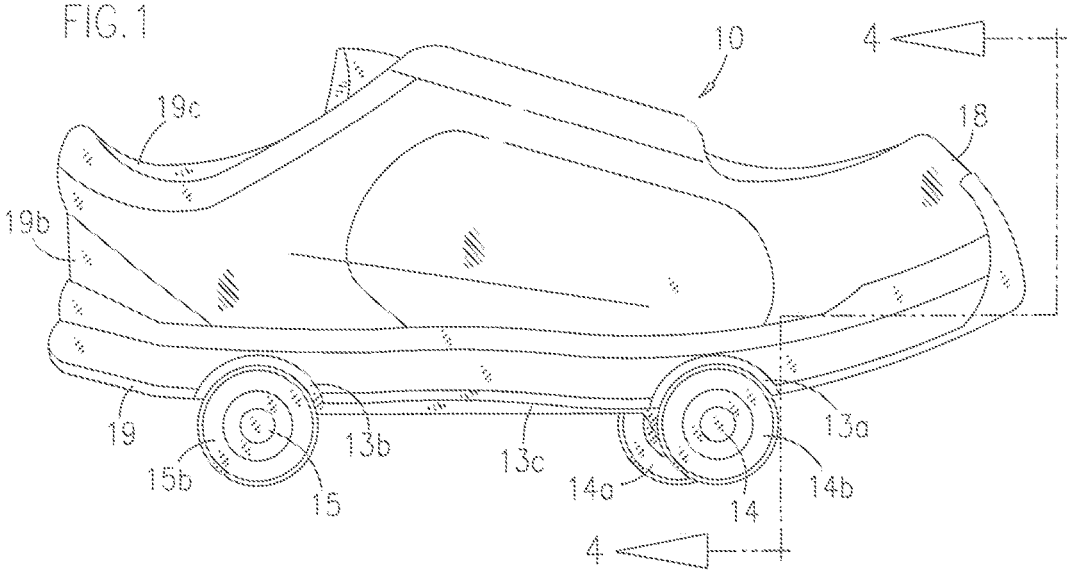
FIG. 1 is a side view of the present invention, a low-rider profile roller skates.

FIG. 1 illustrates a side view of the low-rider roller skate 10 made in accordance with the present invention. The roller skate 10 generally comprising a pair of front wheels 14*a*, 14*b*, attached to a front rotating axle 14 that is mounted to a front portion 12*a* of a first sole 13 of the skate 10, and a pair of rear wheels 15*a*, 15*b*, attached to a rear rotating axle 15 that is attached to a rear portion 12*b* of the first sole 13.

The front and rear wheels can be of any conventional design.

Figure 2:
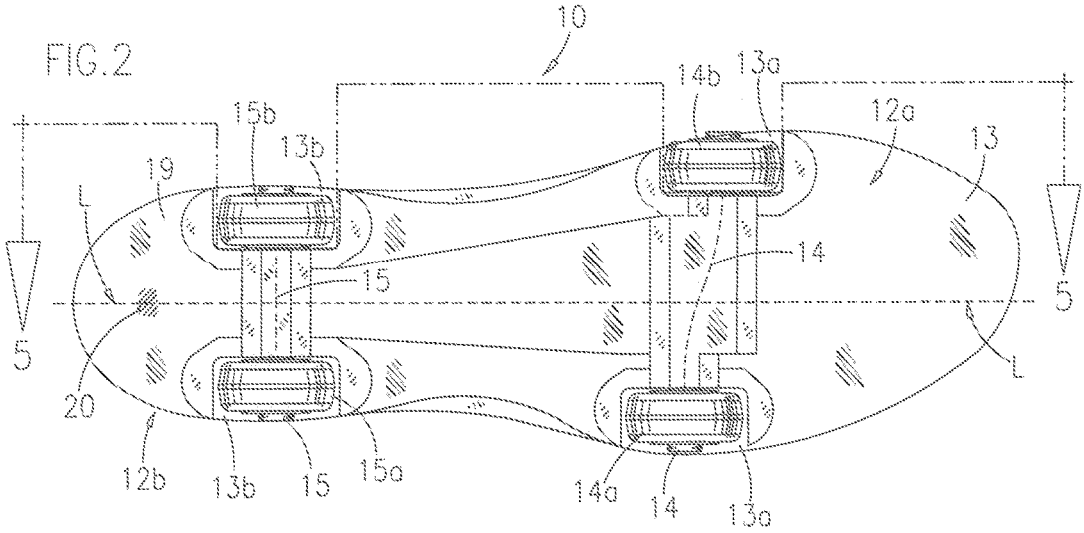
FIG. 2 is a bottom view of the present invention illustrating the angled front axle which is shown in broken lines.

It is important to note the position of the axles 14, 15 in relation to the skater's foot. Unlike prior art skates, the front wheel 14*a* of the present invention is offset from front wheel 14*b*. The front axle 14 (illustrated in broken lines in FIG. 2) is situated along the first sole 13 to be positioned approximately adjacent the ball of the skater's foot, such that wheel 14*b* is approximately adjacent the ball of the skater's foot, while wheel 14*a* is positioned approximately below the ball of the skater's foot. The rear axle 15 as shown, is perpendicular to the length L of the skate 10 and is positioned approximately adjacent the heel of the skater's foot.

As stated, the skate 10 defines a longitudinal length L. The rear axle 15 is perpendicular to that length L, however, unlike prior art skates, the front axle 14 is not parallel with rear axle 15, and as illustrated, the front axle 14 is disposed at an angle A to the length L.

As illustrated, the axles 14, 15 have a length that are approximately equal the width of the skate 10 such that in the preferred embodiment, the front wheels 14*a*, 14*b*, are not positioned outside the outer edge 13*c* of the first sole 13, but instead are each disposed within front cavities 13*a* within the sole 13, such cavities 13*a* sized to allow the wheels 14*a*, 14*b* to freely rotate.

Similarly, in the preferred embodiment, the rear wheels 15*a*, 15*b* are not positioned outside the outer edge 13*c* of the first sole 13, but instead are each disposed within rear cavities 13*b* within the sole 13, such cavities 13*b* sized to allow the wheels 15*a*, 15*b* to rotate freely.

Alternatively, the front axle 14 and rear axle 15 may be extended such that the front wheels 14*a*, 14*b*, and rear wheels 15*a*, 15*b* are not positioned in the cavities in the sole 13, but are positioned outside the outer edge 13*c* of the first sole 13.

Figure 3:
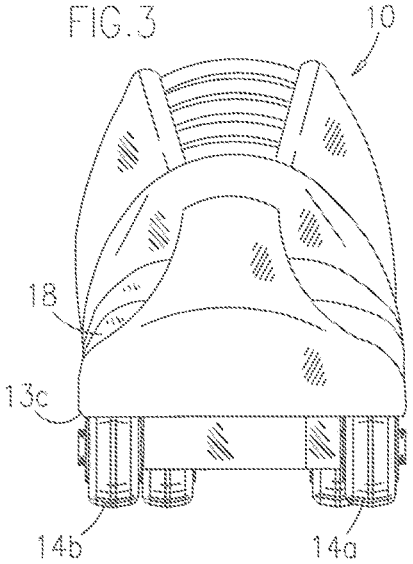
FIG. 3 is a front view of the present invention.
Figure 4:
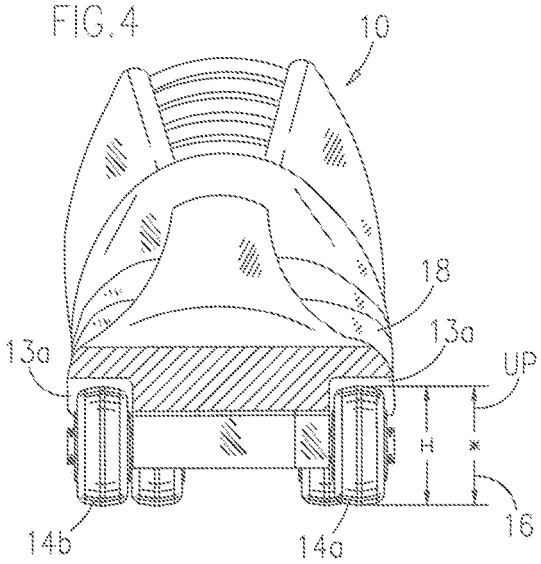
FIG. 4 is a sectional view thereof, taken from line 4-4 in FIG. 1.
Figure 5:
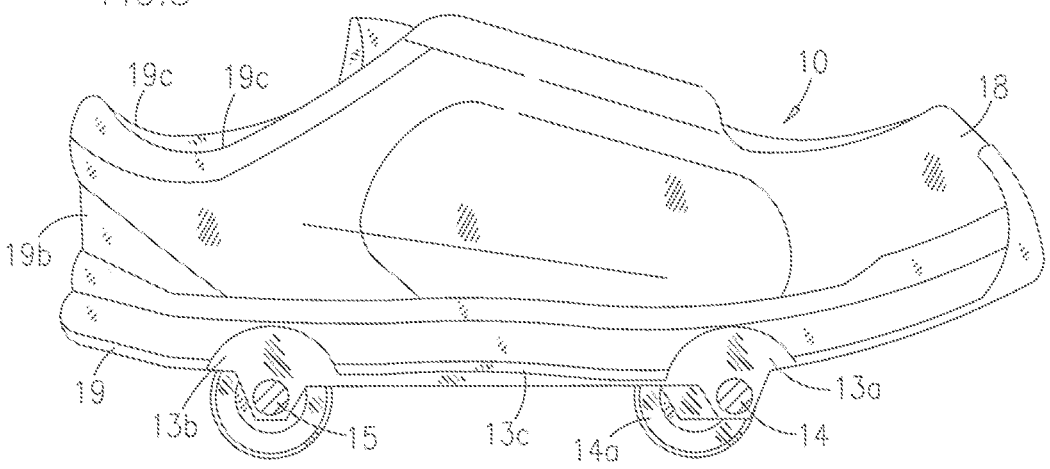
FIG. 5 is a sectional view thereof, taken from line 5-5 in FIG. 2.

As seen in FIGS. 1, 3 and 4, wheels 14*a*, 14*b* and 15*a*, 15*b* each define a height H (referenced in FIG. 4). In the preferred embodiment, just less than approximately 50% of the upper-most portion UP (see FIG. 4) of each wheel is disposed above the outer edge 13*c* of the sole 13, and the balance 16 of the wheel is below the edge 13*c*. It should be understood that having a greater portion of the height H of the wheels disposed above the edge 13*c* of the sole 13 of the skate lessens the distance between the sole 13 and the ground surface. The Inventor has found that this lesser distance, i.e., low profile design, means better control of skating during application.

The front axle 14 is secured to the first sole 13 to freely rotatably receive the front wheels 14*a*, 14*b*. Likewise, the rear axle 15 is secured to the first sole 13 to freely rotatably receive the rear wheels 15*a*, 15*b*.

The first sole 13 preferably includes a magnet 20 positioned approximately adjacent the rear axle 15. The magnet 20 to secure a second sole member 30 by magnetic attraction. As will be discussed, the second sole member 30 is removable, and may include a metal portion 32 for such magnetic attraction. The second sole member 30 being sized to slip over the first sole 13 and configured to impede the wheels from rotating.

With the second sole member 30 attached, the pair of skates 10 no longer act as roller skates but are walking shoes. With the second sole member 30 removed, the skates 10 are low-rider skates as disclosed.

Figure 10:
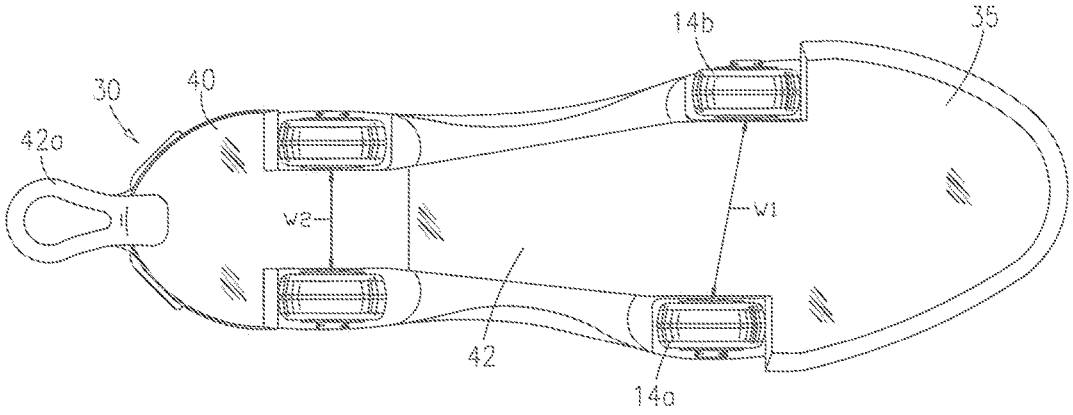
FIG. 10 is a bottom view of the present invention with the second sole member attached.

The second sole member 30 generally includes a cap toe 35 sized for receiving the toe-portion 18 of the skate 10, and second heel 40 that generally rests over the heel-portion 19 of the skate 10, and an integral waist 42 therebetween. The waist 42 has a first width W1 that is approximately equal to the distance between the first and second front wheels 14*a*, 14*b*, and a second width W2 that is approximately equal to the distance between the first and second rear wheels 15*a*, 15*b* (see FIG. 10). In application, the waist 42 is disposed between the wheels 14*a*, 14*b*, and 15*a*, 15*b*, and as illustrated, the waist 42 includes a front indent 44 sized and shaped for receiving the front axle 14, and a rear indent 46 sized and shaped for receiving the rear axle 15.

Figure 14:
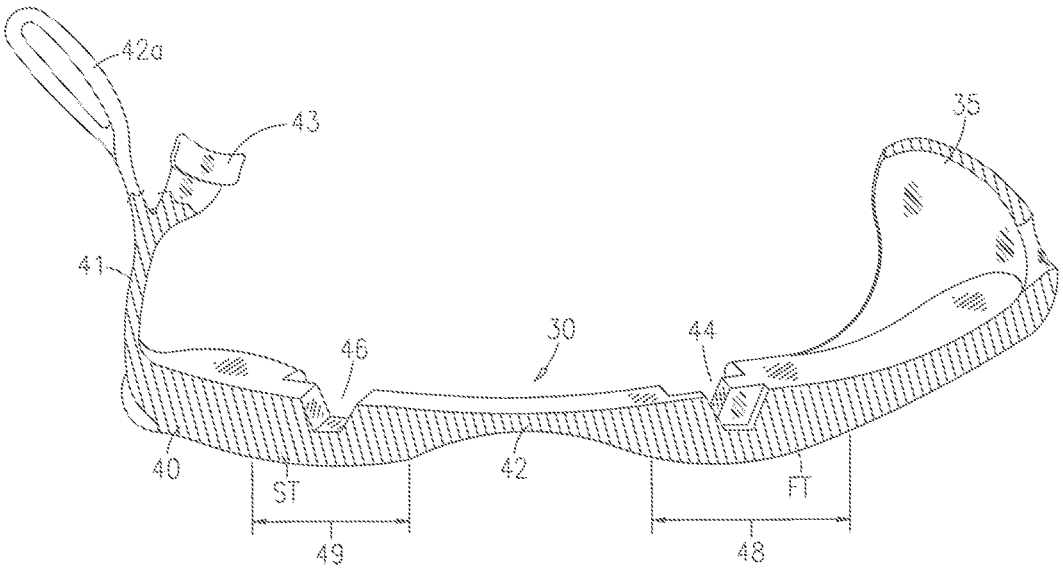
FIG. 14 is a side, cutaway view of the second sole member.
Figure 15:
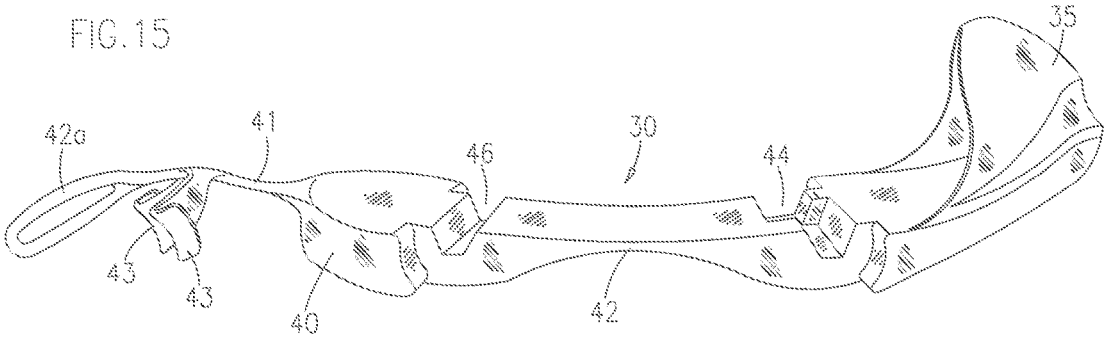
FIG. 15 is a side, perspective view of the second sole member.

Referring to FIG. 14, the waist 42 further defines a front area designated as numeral 48 that has a first thickness FT adjacent the front indent 44 such that when the front axle 14 is received in the front indent 44 as described, the thickness of the waist 42, and more particularly, the front area 48 and the first thickness FT is slightly greater than the length of the balance 16 such that in application, the first thickness FT may contact the ground surface. Further, the waist 42, and more particularly the first thickness FT is constructed of such an appropriate material that when the wearer places his/her body weight on the first sole 13 and second sole 30, the body weight will cause the first thickness FT to expand such that the waist 42 is in contact with the front wheels 14*a*, 14*b*, impeding the wheels 14*a*, 14*b* from rotating.

Similarly, the waist 42 defines a rear area designated as numeral 49 that has a second thickness ST adjacent the rear indent 46 such that when the rear axle 15 is received in the rear indent 46 as described, the thickness of the waist 42, and more particularly, the rear area 49 and the second thickness ST is slightly greater than the length of the balance 16, such that in application, the second thickness ST may contact the ground surface. Further, as described, when the wearer places his/her body weight on the first sole 13 and second sole 30, the body weight will cause the second thickness ST to expand such that the waist 42 is in contact with the rear wheels 15*a*, 15*b*, impeding the wheels 15*a*, 15*b* from rotating.

The first and second thickness FT, ST materials are preferably constructed of a rigid rubber material having the embodiments disclosed.

It should be understood that front and rear areas 48, 49 that include first and second thickness FT, ST, respectively, are configured for additional padding around the skater/wearer's heel (rear area 49) and that area upon which the body weight rests between the wearer's arch and toes (front area 48).

The front and rear areas 48, 49 designed to give the second sole member 30 ability to absorb foot stroke forces in application and to further provide comfort and stability.

Figure 6:
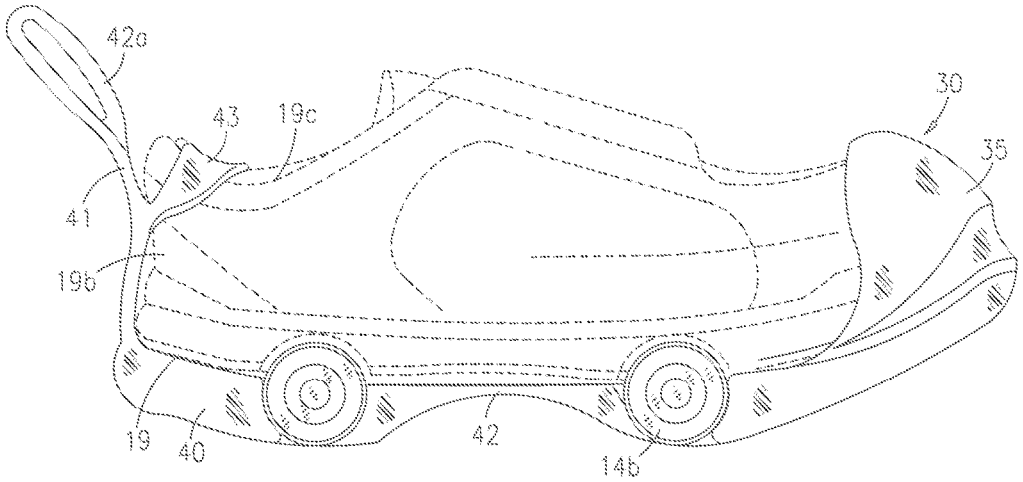
FIG. 6 is a first side view of the present invention with the second sole member attached, the present low-rider profile roller skate shown in broken lines to better illustrate the second sole member embodiments.
Figure 7:
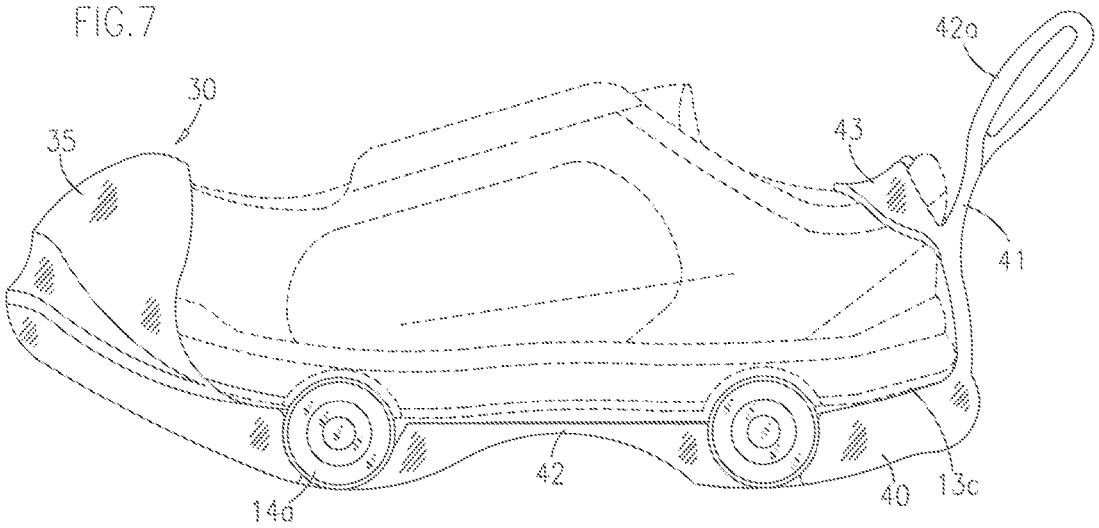
FIG. 7 is a second, opposite side view of the present invention with the second sole member attached, the present low-rider profile roller skate shown in broken lines to better illustrate the second sole member embodiments.
Figure 8:
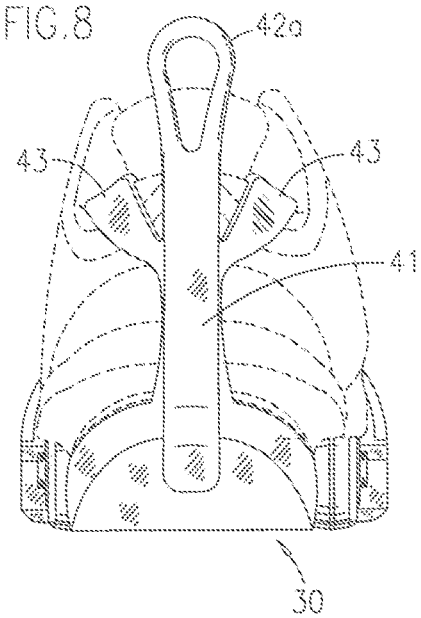
FIG. 8 is a rear view of the present invention with the second sole member attached, the present low-rider profile roller skate shown in broken lines to better illustrate the second sole member embodiments.
Figure 9:
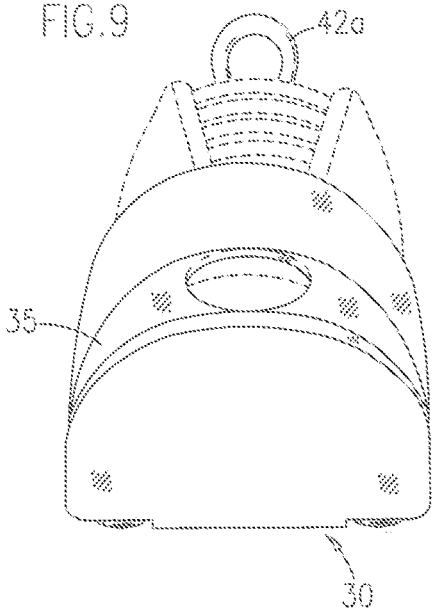
FIG. 9 is a front view of the present invention with the second sole member attached, the present low-rider profile roller skate shown in broken lines to better illustrate the second sole member embodiments.

In application, to attach the second sole member 30, the skater, while optionally wearing the skate 10, first inserts the toe-portion 18 of the skate 10 into the cap toe 35, and then urges the second heel 40 over the heel portion 19 by handling a loop 42*a* of strap 41 that extends from the heel end 40 until an at least one hook 43 releasably connects with the collar 19*c* of the skate's 10 back portion 19*b* as shown in FIG. 6.

Figure 11:
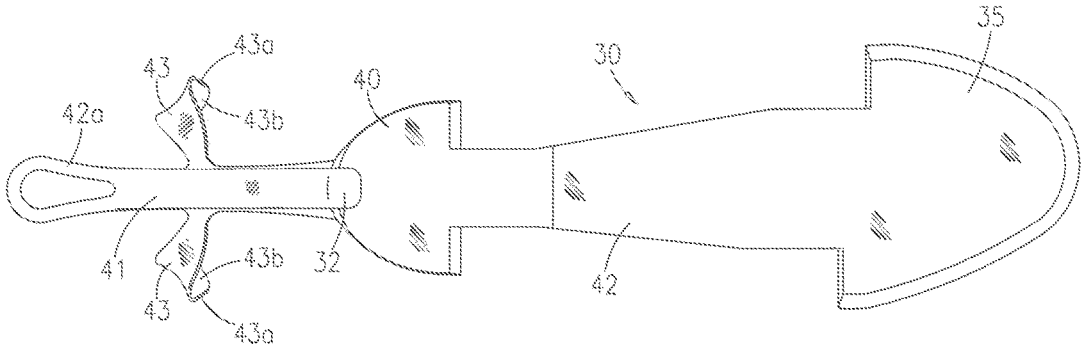
FIG. 11 is a bottom view of the second sole member.
Figure 12:
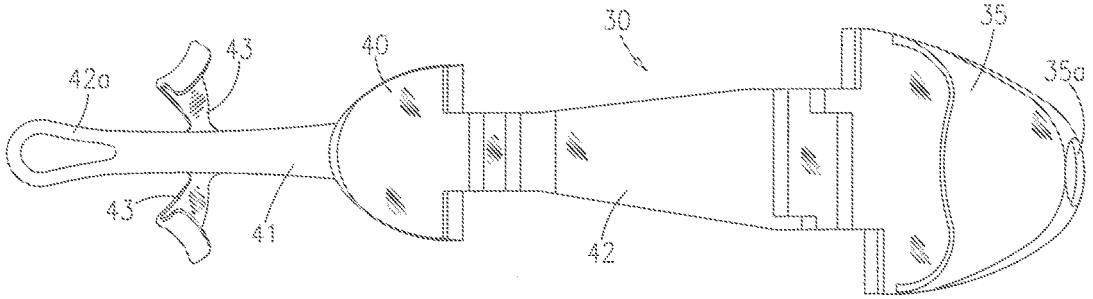
FIG. 12 is a top view of the second sole member.
Figure 13:
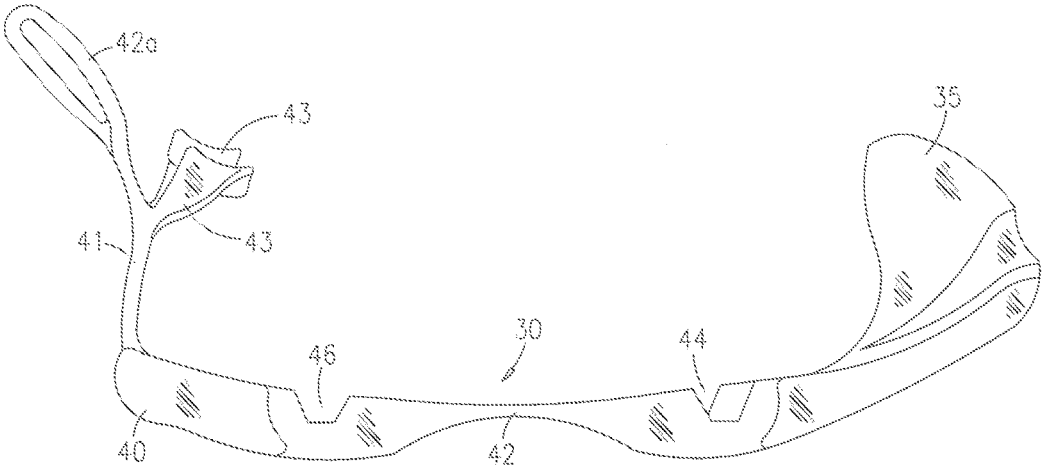
FIG. 13 is a side view of the second sole member.

Referring to FIG. 11, the at least one hook 43 includes a lip 43*a* and defines a slot 43*b* that as shown in the drawings, is sized for receiving the collar 19*c*.

It should be understood that when urging the second heel 40 with strap 41 as described, the skater aligns the axles 14, 15 with the indents 44, 46, for proper positioning, and further approximately aligns the metal portion 42 on the second sole member 30 with the magnet 20 disposed on the skate 10 for further attraction.

Figure 16:
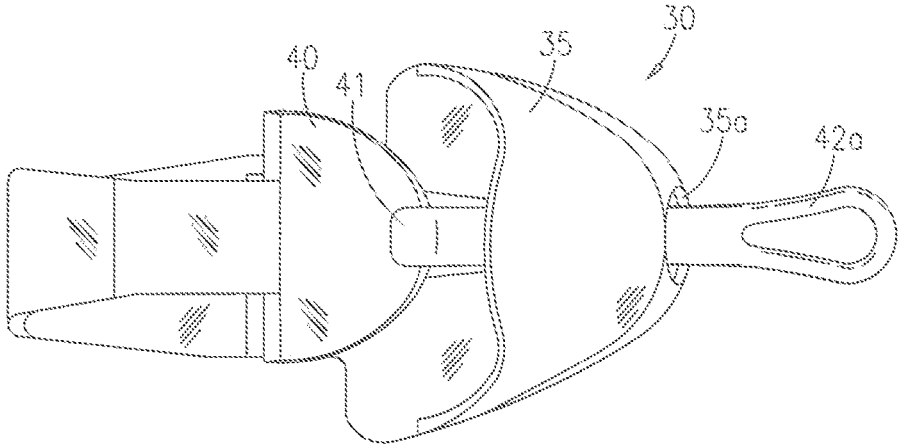
FIG. 16 is a top view of the second sole member with the second heel tucked in the cap toe for storage.

As shown in FIG. 16, when not in use, the second heel 40 can be received within the cap toe 35 such that the loop 42*a* extends through an aperture 35*a* of the cap toe 35. The skater can then attach the loop 42*a* to the skater's belt or backpack, for example, to securely maintain the second sole member 30 for later application.

Although the above description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A low-rider roller skate comprising:

first and second front wheels attached to a front rotating axle that is mounted to a first sole, first and second rear wheels attached to a rear rotating axle that is mounted to said first sole, wherein said first front wheel is offset from said second front wheel such that in application said first front wheel is approximately adjacent a ball of a skater's foot, and wherein said second front wheel is positioned approximately below the ball of the skater's foot, and wherein said rear axle is adjacent a heel of the skater's foot, said skate defines a longitudinal length, and wherein said rear axle is perpendicular to said length and said front axle is disposed at an angle to said length.

2. The low-rider roller skate of claim 1, wherein said first sole further including a magnet positioned approximately adjacent the rear axle.

3. The low-rider roller skate of claim 2, further comprising a second sole member including a cap toe sized for receiving a toe-portion of the low-rider roller skate, and a second heel that rests over a heel-portion of the roller skate, and an integral waist therebetween, said waist extends between said first and second front wheels and said first and second rear wheels and includes a front indent for receiving the front axle, and a rear indent for receiving the rear axle.

4. The low-rider roller skate of claim 3, wherein said waist further defines a first thickness adjacent the front indent.

5. The low-rider roller skate of claim 4, wherein said waist further defines a second thickness adjacent the rear indent.

6. The low-rider roller skate of claim 5, wherein said second sole further including a loop attached to a strap that extends from the heel end, said strap further including at least one hook that releasably connects with a collar of a back portion of said roller skate.

7. The low-rider roller skate of claim 6, wherein said at least one hook including a lip and a slot sized for receiving said collar.

8. The low-rider roller skate of claim 7, wherein said second sole further includes a metal portion adjacent said second heel configured for magnetic attraction with said magnet.

9. A low-rider roller skate comprising:

a first front wheel positioned approximately adjacent a ball of a wearer's foot, a second front wheel positioned approximately below the ball of the wearer's foot, and wherein said first and second front wheels are attached to a front rotating axle that is mounted to a front portion of a first sole, and a first and second rear wheel attached to a rear rotating axle that is attached to a rear portion of the first sole, said rear axle positioned approximately adjacent a heel of the skater's foot, and wherein said roller skate defines a longitudinal length, and said rear axle is perpendicular to said length and said front axle is disposed at an angle to said length, wherein an upper portion of each of said first and second front wheels and said first and second rear wheels are disposed above a lower most edge of said first sole.

10. The low-rider roller skate of claim 9, wherein said upper portion is just less than approximately 50% of each of said first and second front and rear wheels.

11. The low-rider roller skate of claim 10, further comprising a second sole member including a cap toe sized for receiving a toe-portion of the roller skate, and a second heel that rests over a heel-portion of the roller skate, and an integral waist therebetween, said waist defines a first width that is disposed between said first and second front wheels, and a second width that is disposed between said first and second rear wheels, and said waist further includes a front indent for receiving the front axle and a rear indent for receiving the rear axle, and said first width having a first thickness configured to impede the first and second front wheels from rotating, and said second width having a second thickness configured to impede said first and second rear wheels from rotating.

12. The low-rider roller skate of claim 11, wherein said second sole further including a strap that extends from the heel end, said strap including a loop and at least one hook that releasably connects with a collar of a back portion of said roller skate.

13. The low-rider roller skate of claim 12, wherein said at least one hook including a lip and defines a slot sized for receiving said collar.

14. The low-rider roller skate of claim 9, wherein said first sole further includes a magnet positioned approximately adjacent the rear axle, and said second sole includes a metal for attraction with said magnet.

15. A low-rider roller skate comprising:

first and second front wheels attached to a front axle that is mounted to a first sole, first and second rear wheels attached to a rear axle that is mounted to said first sole, wherein said first front wheel is approximately above a ball of a skater's foot and said second front wheel is positioned approximately below the ball of the skater's foot, and wherein said rear axle adjacent a heel of the skater's foot, and wherein said skate defines a longitudinal length, and said rear axle is perpendicular to said length and said front axle is disposed at an angle to said length.

16. The low-rider roller skate of claim 15, wherein said first sole further including a magnet positioned approximately adjacent the rear axle.

17. The low-rider roller skate of claim 16, further including a second sole member having a cap toe sized for receiving a toe-portion of the roller skate and a second heel that rests over a heel-portion of the roller skate, and an integral waist therebetween, said waist includes a front indent for receiving the front axle, and a rear indent for receiving the rear axle.

18. The low-rider roller skate of claim 17, wherein said waist further defines a first thickness that extends between said first and second front wheels and configured to impede the first and second front wheels from rotating, and a second thickness that extends between said first and second rear wheels and configured to impede the first and second rear wheels from rotating.

19. The low-rider roller skate of claim 18, said second sole further including a strap that extends from the heel end, said strap including a loop and at least one hook, said at least one hook including a lip and defines a slot sized for receiving a collar of a back portion of said roller skate.

20. The low-rider roller skate of claim 19, wherein said second sole further includes a metal portion adjacent said second heel configured to magnetically attract said magnet.

* * * * *